US011168919B2

(12) United States Patent
Jenks et al.

(10) Patent No.: US 11,168,919 B2
(45) Date of Patent: Nov. 9, 2021

(54) REMOVABLE DIP SWITCH FOR SETTING ADDRESS

(71) Applicant: Johnson Controls Technology Company, Auburn Hills, MI (US)

(72) Inventors: Russell T. Jenks, Racine, WI (US); Cory C. Strebe, Wauwatosa, WI (US); Kevin A. Weiss, Gurnee, IL (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 763 days.

(21) Appl. No.: 15/979,867

(22) Filed: May 15, 2018

(65) Prior Publication Data

US 2019/0353389 A1 Nov. 21, 2019

(51) Int. Cl.

| | |
|---|---|
| ***F24F 11/89*** | (2018.01) |
| ***H01H 15/00*** | (2006.01) |
| ***F24F 11/65*** | (2018.01) |
| ***F24F 11/88*** | (2018.01) |

(52) U.S. Cl.

CPC ..... *F24F 11/89* (2018.01); *F24F 11/65* (2018.01); *F24F 11/88* (2018.01); *H01H 15/005* (2013.01)

(58) Field of Classification Search

CPC . F24F 11/65; F24F 11/88; F24F 11/89; H01H 15/005

See application file for complete search history.

(56) References Cited

U.S. PATENT DOCUMENTS

| | | | | |
|---|---|---|---|---|
| 4,658,101 | A * | 4/1987 | Akimoto | H01H 15/005 200/16 D |
| 4,886,946 | A * | 12/1989 | Franks, Jr. | H01H 15/005 200/329 |
| 5,513,074 | A | 4/1996 | Ainsbury et al. | |
| 6,011,224 | A * | 1/2000 | Zdanys, Jr. | H01H 15/005 200/16 D |
| 6,570,825 | B2 | 5/2003 | Miranda et al. | |
| 6,760,228 | B1 | 7/2004 | Chi et al. | |
| 2005/0156052 | A1* | 7/2005 | Bartlett | F24F 11/0001 236/49.3 |
| 2013/0116834 | A1* | 5/2013 | Grabinger | F24F 11/00 700/276 |

* cited by examiner

*Primary Examiner* — Kidest Bahta
(74) *Attorney, Agent, or Firm* — Foley & Lardner LLP

(57) ABSTRACT

A removable circuit card assembly configured to be inserted into an HVAC device is provided. The removable circuit card assembly includes a printed wiring board, an enclosure cap coupled to the printed wiring board, and a dual in-line package (DIP) switch component coupled to the printed wiring board. The DIP switch component includes multiple DIP switches. Each of the DIP switches is configured to be actuated between a first position and a second position.

15 Claims, 10 Drawing Sheets

REMOVABLE DIP SWITCH FOR SETTING ADDRESS

BACKGROUND

The present disclosure relates generally to the field of building management systems and associated devices and more particularly to a removable dual in-line package (DIP) switch circuit card assembly (CCA) for an HVAC system actuator.

DIP switches are utilized to select various settings on actuators or other HVAC equipment. For example, a DIP switch setting on a spring return actuator can be used to select a spring return direction, while a configuration of multiple DIP switch settings on a fire damper actuator can be used to identify a unique address for the actuator in a fire system. Often, actuator DIP switches are mounted to a main control board that is reachable via an access door. However, this design poses a problem when the installation location of the actuator faces ductwork that blocks the access door. In some areas, local fire codes may prevent the removal of fire damper actuators, and technicians are forced to reach into and around ductwork in order to set the DIP switches. A design that avoids these issues would therefore be useful.

SUMMARY

One implementation of the disclosure relates to a removable circuit card assembly configured to be inserted into an HVAC device. The removable circuit card assembly includes a printed wiring board, an enclosure cap coupled to the printed wiring board, and a dual in-line package (DIP) switch component coupled to the printed wiring board. The DIP switch component includes multiple DIP switches. Each of the DIP switches is configured to be actuated between a first position and a second position.

In some embodiments, the DIP switches include at least one of slide-style switches, rocker-style switches, and piano-style switches.

In some embodiments, actuating one of the DIP switches into the first position causes the DIP switch component to transmit a nonzero voltage signal. Actuating the one of the DIP switches into the second position causes the DIP switch component to transmit a zero voltage signal.

In some embodiments, the enclosure cap includes a handle protrusion. The handle protrusion is configured to be gripped by a user to decouple the removable circuit card assembly from the HVAC device.

In some embodiments, the enclosure cap includes a seal component configured to prevent fluid ingress into the HVAC device.

In some embodiments, the removable circuit card assembly includes multiple connector pins. The connector pins are configured to electrically couple to a connector mounted inside the HVAC device.

Another implementation of the present disclosure is an actuator in an HVAC system. The actuator includes a motor, a drive device driven by the motor and coupled to a movable HVAC component for driving the movable HVAC component between multiple positions, and a removable dual in-line package (DIP) switch circuit card assembly. The actuator further includes a processing circuit coupled to the motor and the removable DIP switch circuit card assembly and configured to operate the motor to drive the drive device, and an enclosure configured to at least partially encapsulate the motor, the drive device, the removable DIP switch circuit card assembly, and the processing circuit.

In some embodiments, the actuator includes an input connection and an output connection located proximate an exterior surface of the enclosure. In other embodiments, the exterior surface of the enclosure includes an aperture configured to permit the removable DIP switch circuit card assembly to be decoupled from the processing circuit in a direction parallel to the input connection and the output connection.

In some embodiments, the removable DIP switch circuit card assembly includes a printed wiring board, an enclosure cap coupled to the printed wiring board, and a DIP switch component coupled to the printed wiring board and including multiple DIP switches. In other embodiments, the processing circuit is further configured to set an address for the actuator based on positions of the multiple DIP switches. In other embodiments, each of the DIP switches is configured to be actuated between a first position and a second position. In further embodiments, actuating one of the DIP switches into the first position causes the DIP switch component to transmit a nonzero voltage signal. Actuating one of the DIP switches into the second position cause the DIP switch component to transmit a zero voltage signal.

In some embodiments, the removable DIP switch circuit card assembly includes multiple connector pins. The connector pins are configured to electrically couple to a connector coupled to the processing circuit.

In some embodiments, the enclosure cap includes an exterior flange portion and an interior flange portion. The exterior flange portion is configured to sit substantially flush with an exterior surface of the enclosure when the removable DIP switch circuit card assembly is in a fully installed configuration. In other embodiments, the exterior flange portion includes a handle protrusion. The handle protrusion is configured to be gripped by a user to decouple the removable DIP switch circuit card assembly from the processing circuit. In still further embodiments, the enclosure cap includes comprises a seal component located proximate a joint coupling the exterior flange portion to the interior flange portion. The seal component is configured to prevent fluid ingress into the enclosure.

Yet another implementation of the present disclosure is a method of changing a device configuration of an actuator having a processing circuit card assembly detachably coupled to a dual in-line package (DIP) switch circuit card assembly. The method includes detecting removal of the DIP switch circuit card assembly and detecting replacement of the DIP switch circuit card assembly. The method further includes receiving a device address signal from the DIP switch circuit card assembly. The device address signal includes a set of voltage signals. Each of the set of voltage signals is based on a position of a corresponding DIP switch of the DIP switch circuit card assembly. The method additionally includes setting a device configuration of the actuator based on the set of voltage signals.

In some embodiments, the method is performed by the processing circuit card assembly.

In some embodiments, the device configuration is at least one of a device address and an operational setting. The device address is configured to uniquely identify the actuator, while the operational setting is configured to modify the actuator performance.

DETAILED DESCRIPTION

Referring generally to the FIGURES, various embodiments of HVAC equipment with a removable DIP switch package for addressing setting are depicted. The DIP switch package is mounted on a printed wiring board (PWB) to form a circuit card assembly (CCA) that is fully removable from the actuator enclosure, similar to a universal serial bus (USB) memory stick. It should be understood that the disclosure is not limited to the details or methodology set forth in the description or illustrated in the figures. It should also be understood that the terminology is for the purpose of description only and should not be regarded as limiting.

Building Management System and HVAC System

Figure 1:
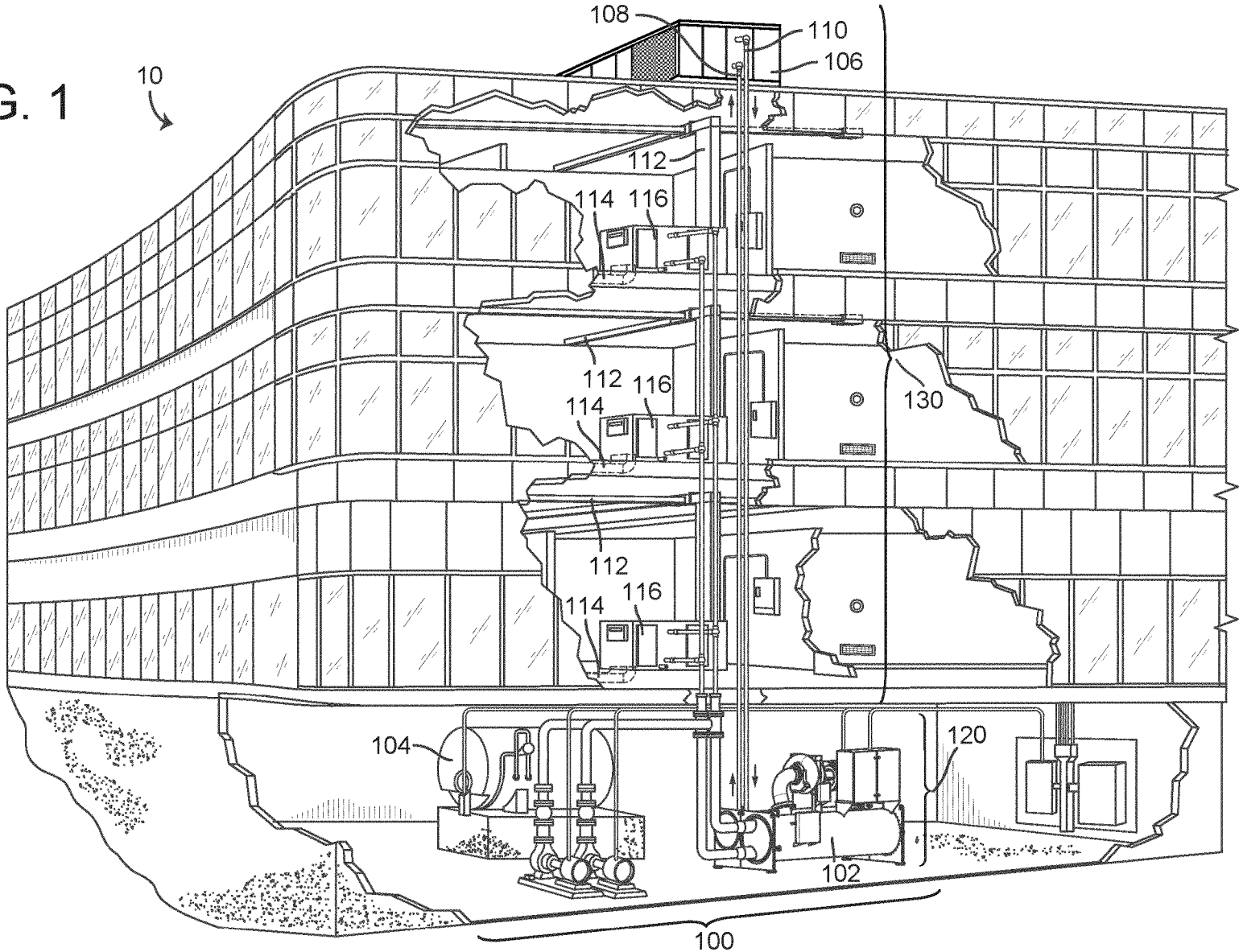
FIG. 1 is a perspective view of a building with a heating, ventilation, or air conditioning (HVAC) system and a building management system (BMS), according to some embodiments.

Referring now to FIGS. 1-4, a building management system (BMS) and HVAC system in which the systems and methods of the present disclosure can be implemented are shown, according to some embodiments. Referring particularly to FIG. 1, a perspective view of a building 10 is shown. Building 10 is served by a BMS. A BMS is, in general, a system of devices configured to control, monitor, and manage equipment in or around a building or building area. A BMS can include, for example, a HVAC system, a security system, a lighting system, a fire alerting system, any other system that is capable of managing building functions or devices, or any combination thereof.

The BMS that serves building 10 includes an HVAC system 100. HVAC system 100 can include multiple HVAC devices (e.g., heaters, chillers, air handling units, pumps, fans, thermal energy storage, etc.) configured to provide heating, cooling, ventilation, or other services for building 10. For example, HVAC system 100 is shown to include a waterside system 120 and an airside system 130. Waterside system 120 can provide a heated or chilled fluid to an air handling unit of airside system 130. Airside system 130 can use the heated or chilled fluid to heat or cool an airflow provided to building 10. A waterside system and airside system which can be used in HVAC system 100 are described in greater detail with reference to FIGS. 2-3.

HVAC system 100 is shown to include a chiller 102, a boiler 104, and a rooftop air handling unit (AHU) 106. Waterside system 120 can use boiler 104 and chiller 102 to heat or cool a working fluid (e.g., water, glycol, etc.) and can circulate the working fluid to AHU 106. In various embodiments, the HVAC devices of waterside system 120 can be located in or around building 10 (as shown in FIG. 1) or at an offsite location such as a central plant (e.g., a chiller plant, a steam plant, a heat plant, etc.). The working fluid can be heated in boiler 104 or cooled in chiller 102, depending on whether heating or cooling is required in building 10. Boiler 104 can add heat to the circulated fluid, for example, by burning a combustible material (e.g., natural gas) or using an electric heating element. Chiller 102 can place the circulated fluid in a heat exchange relationship with another fluid (e.g., a refrigerant) in a heat exchanger (e.g., an evaporator) to absorb heat from the circulated fluid. The working fluid from chiller 102 and/or boiler 104 can be transported to AHU 106 via piping 108.

AHU 106 can place the working fluid in a heat exchange relationship with an airflow passing through AHU 106 (e.g., via one or more stages of cooling coils and/or heating coils). The airflow can be, for example, outside air, return air from within building 10, or a combination of both. AHU 106 can transfer heat between the airflow and the working fluid to provide heating or cooling for the airflow. For example, AHU 106 can include one or more fans or blowers configured to pass the airflow over or through a heat exchanger containing the working fluid. The working fluid can then return to chiller 102 or boiler 104 via piping 110.

Airside system 130 can deliver the airflow supplied by AHU 106 (i.e., the supply airflow) to building 10 via air supply ducts 112 and can provide return air from building 10 to AHU 106 via air return ducts 114. In some embodiments, airside system 130 includes multiple variable air volume (VAV) units 116. For example, airside system 130 is shown to include a separate VAV unit 116 on each floor or zone of building 10. VAV units 116 can include dampers or other flow control elements that can be operated to control an amount of the supply airflow provided to individual zones of building 10. In other embodiments, airside system 130 delivers the supply airflow into one or more zones of building 10 (e.g., via supply ducts 112) without using intermediate VAV units 116 or other flow control elements. AHU 106 can include various sensors (e.g., temperature sensors, pressure sensors, etc.) configured to measure attributes of the supply airflow. AHU 106 can receive input from sensors located within AHU 106 and/or within the building zone and can adjust the flow rate, temperature, or other attributes of the supply airflow through AHU 106 to achieve setpoint conditions for the building zone.

Figure 2:
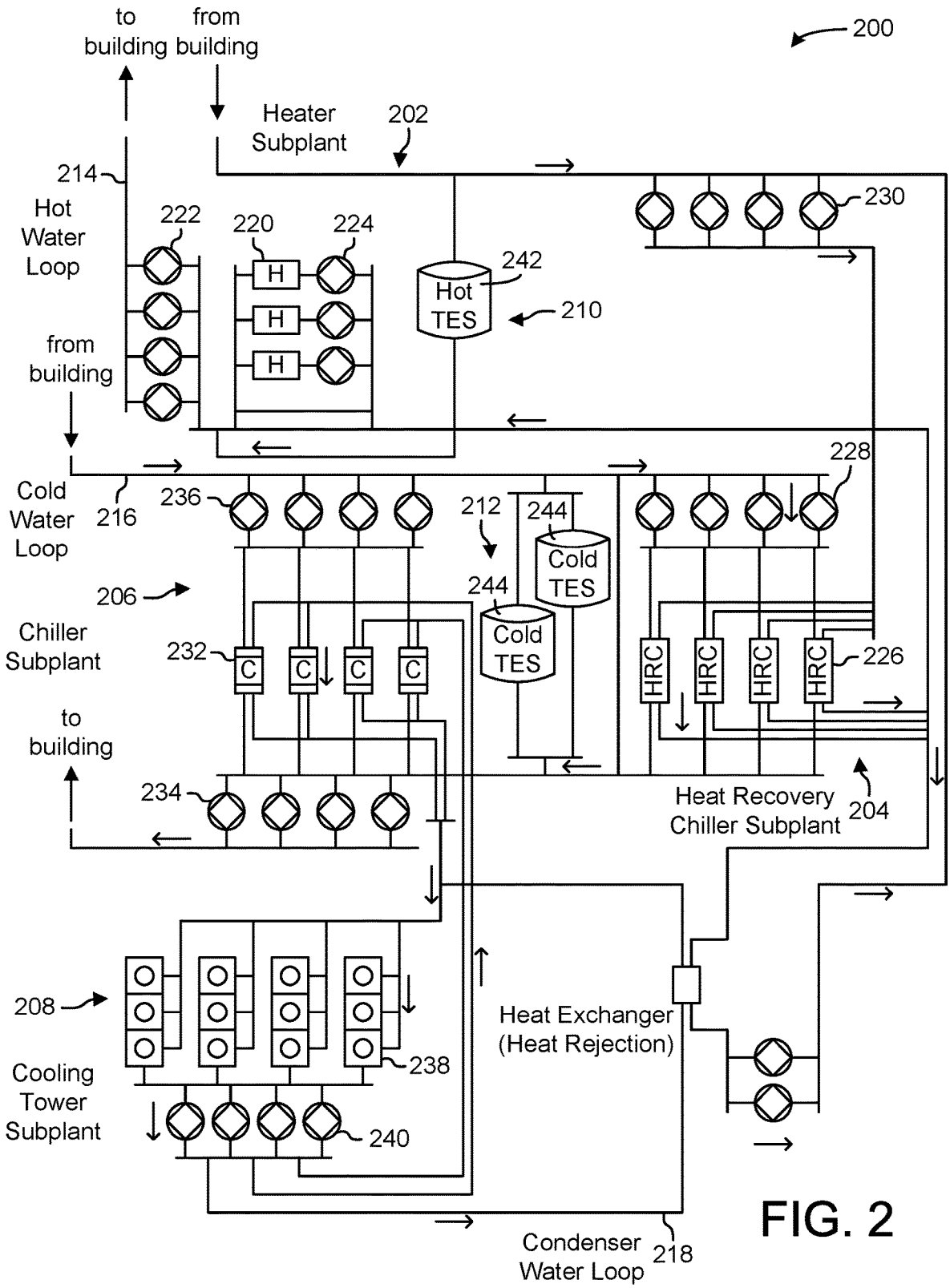
FIG. 2 is a schematic diagram of a waterside system which can be used to support the HVAC system of FIG. 1, according to some embodiments.

Referring now to FIG. 2, a block diagram of a waterside system 200 is shown, according to some embodiments. In various embodiments, waterside system 200 can supplement or replace waterside system 120 in HVAC system 100 or can be implemented separate from HVAC system 100. When implemented in HVAC system 100, waterside system 200 can include a subset of the HVAC devices in HVAC system 100 (e.g., boiler 104, chiller 102, pumps, valves, etc.) and can operate to supply a heated or chilled fluid to AHU 106. The HVAC devices of waterside system 200 can be located within building 10 (e.g., as components of waterside system 120) or at an offsite location such as a central plant.

In FIG. 2, waterside system 200 is shown as a central plant having multiple subplants 202-212. Subplants 202-212 are shown to include a heater subplant 202, a heat recovery chiller subplant 204, a chiller subplant 206, a cooling tower subplant 208, a hot thermal energy storage (TES) subplant 210, and a cold thermal energy storage (TES) subplant 212. Subplants 202-212 consume resources (e.g., water, natural gas, electricity, etc.) from utilities to serve the thermal energy loads (e.g., hot water, cold water, heating, cooling, etc.) of a building or campus. For example, heater subplant 202 can be configured to heat water in a hot water loop 214 that circulates the hot water between heater subplant 202 and building 10. Chiller subplant 206 can be configured to chill water in a cold water loop 216 that circulates the cold water between chiller subplant 206 building 10. Heat recovery chiller subplant 204 can be configured to transfer heat from cold water loop 216 to hot water loop 214 to provide additional heating for the hot water and additional cooling for the cold water. Condenser water loop 218 can absorb heat from the cold water in chiller subplant 206 and reject the absorbed heat in cooling tower subplant 208 or transfer the absorbed heat to hot water loop 214. Hot TES subplant 210 and cold TES subplant 212 can store hot and cold thermal energy, respectively, for subsequent use.

Hot water loop 214 and cold water loop 216 can deliver the heated and/or chilled water to air handlers located on the rooftop of building 10 (e.g., AHU 106) or to individual floors or zones of building 10 (e.g., VAV units 116). The air handlers push air past heat exchangers (e.g., heating coils or cooling coils) through which the water flows to provide heating or cooling for the air. The heated or cooled air can be delivered to individual zones of building 10 to serve the thermal energy loads of building 10. The water then returns to subplants 202-212 to receive further heating or cooling.

Although subplants 202-212 are shown and described as heating and cooling water for circulation to a building, it is understood that any other type of working fluid (e.g., glycol, CO2, etc.) can be used in place of or in addition to water to serve the thermal energy loads. In other embodiments, subplants 202-212 can provide heating and/or cooling directly to the building or campus without requiring an intermediate heat transfer fluid. These and other variations to waterside system 200 are within the teachings of the present invention.

Each of subplants 202-212 can include a variety of equipment configured to facilitate the functions of the subplant. For example, heater subplant 202 is shown to include multiple heating elements 220 (e.g., boilers, electric heaters, etc.) configured to add heat to the hot water in hot water loop 214. Heater subplant 202 is also shown to include several pumps 222 and 224 configured to circulate the hot water in hot water loop 214 and to control the flow rate of the hot water through individual heating elements 220. Chiller subplant 206 is shown to include multiple chillers 232 configured to remove heat from the cold water in cold water loop 216. Chiller subplant 206 is also shown to include several pumps 234 and 236 configured to circulate the cold water in cold water loop 216 and to control the flow rate of the cold water through individual chillers 232.

Heat recovery chiller subplant 204 is shown to include multiple heat recovery heat exchangers 226 (e.g., refrigeration circuits) configured to transfer heat from cold water loop 216 to hot water loop 214. Heat recovery chiller subplant 204 is also shown to include several pumps 228 and 230 configured to circulate the hot water and/or cold water through heat recovery heat exchangers 226 and to control the flow rate of the water through individual heat recovery heat exchangers 226. Cooling tower subplant 208 is shown to include multiple cooling towers 238 configured to remove heat from the condenser water in condenser water loop 218. Cooling tower subplant 208 is also shown to include several pumps 240 configured to circulate the condenser water in condenser water loop 218 and to control the flow rate of the condenser water through individual cooling towers 238.

Hot TES subplant 210 is shown to include a hot TES tank 242 configured to store the hot water for later use. Hot TES subplant 210 can also include one or more pumps or valves configured to control the flow rate of the hot water into or out of hot TES tank 242. Cold TES subplant 212 is shown to include cold TES tanks 244 configured to store the cold water for later use. Cold TES subplant 212 can also include one or more pumps or valves configured to control the flow rate of the cold water into or out of cold TES tanks 244.

In some embodiments, one or more of the pumps in waterside system 200 (e.g., pumps 222, 224, 228, 230, 234, 236, and/or 240) or pipelines in waterside system 200 include an isolation valve associated therewith. Isolation valves can be integrated with the pumps or positioned upstream or downstream of the pumps to control the fluid flows in waterside system 200. In various embodiments, waterside system 200 can include more, fewer, or different types of devices and/or subplants based on the particular configuration of waterside system 200 and the types of loads served by waterside system 200.

Figure 3:
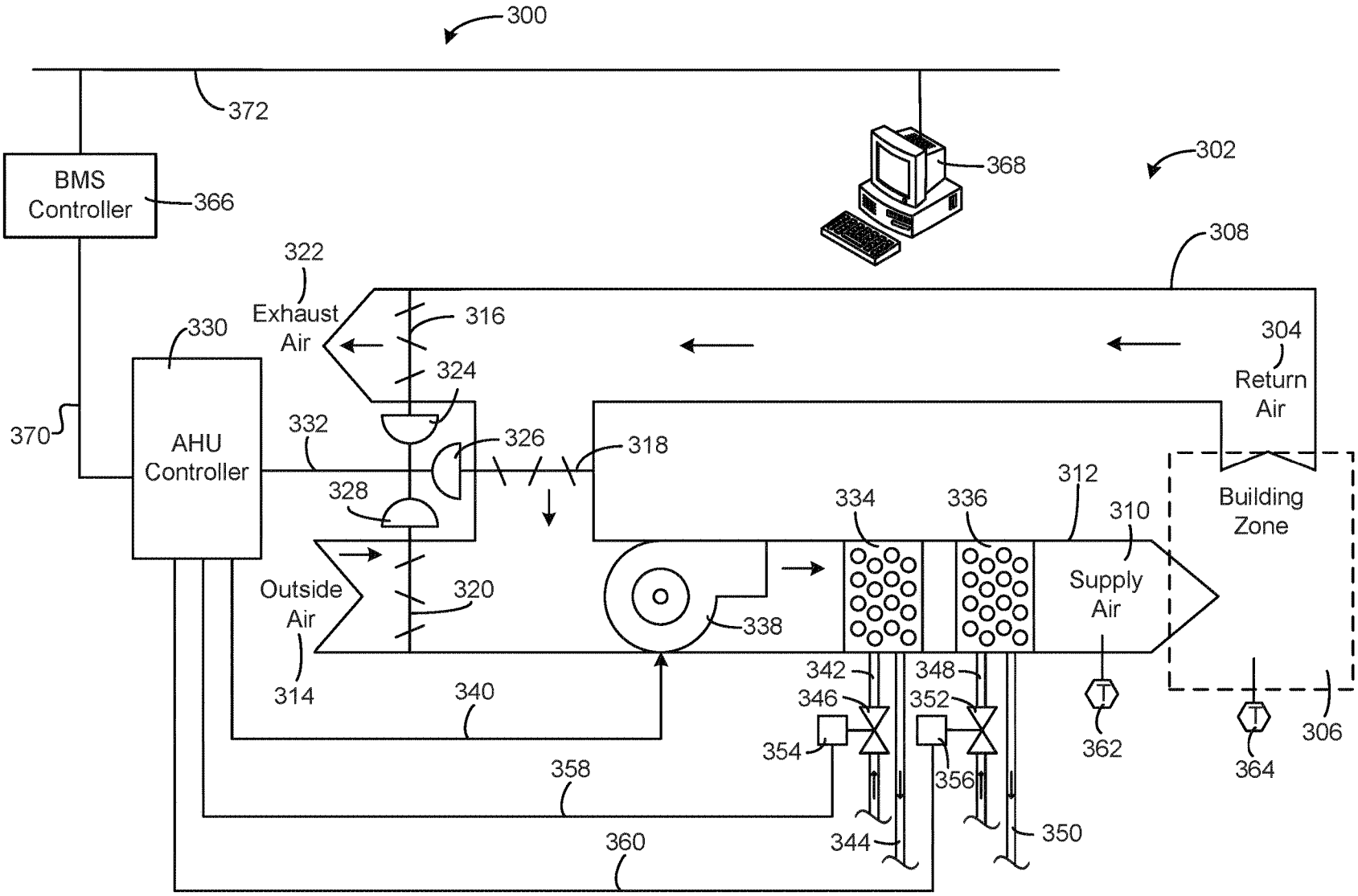
FIG. 3 is a block diagram of an airside system which can be used as part of the HVAC system of FIG. 1, according to some embodiments.

Referring now to FIG. 3, a block diagram of an airside system 300 is shown, according to some embodiments. In various embodiments, airside system 300 can supplement or replace airside system 130 in HVAC system 100 or can be implemented separate from HVAC system 100. When implemented in HVAC system 100, airside system 300 can include a subset of the HVAC devices in HVAC system 100 (e.g., AHU 106, VAV units 116, ducts 112-114, fans, dampers, etc.) and can be located in or around building 10. Airside system 300 can operate to heat or cool an airflow provided to building 10 using a heated or chilled fluid provided by waterside system 200.

In FIG. 3, airside system 300 is shown to include an economizer-type air handling unit (AHU) 302. Economizer-type AHUs vary the amount of outside air and return air used by the air handling unit for heating or cooling. For example, AHU 302 can receive return air 304 from building zone 306 via return air duct 308 and can deliver supply air 310 to building zone 306 via supply air duct 312. In some embodiments, AHU 302 is a rooftop unit located on the roof of building 10 (e.g., AHU 106 as shown in FIG. 1) or otherwise positioned to receive both return air 304 and outside air 314. AHU 302 can be configured to operate exhaust air damper 316, mixing damper 318, and outside air damper 320 to control an amount of outside air 314 and return air 304 that combine to form supply air 310. Any return air 304 that does not pass through mixing damper 318 can be exhausted from AHU 302 through exhaust damper 316 as exhaust air 322.

Each of dampers 316-320 can be operated by an actuator. For example, exhaust air damper 316 can be operated by actuator 324, mixing damper 318 can be operated by actuator 326, and outside air damper 320 can be operated by actuator 328. Actuators 324-328 can communicate with an AHU controller 330 via a communications link 332. Actuators 324-328 can receive control signals from AHU controller 330 and can provide feedback signals to AHU controller 330. Feedback signals can include, for example, an indication of a current actuator or damper position, an amount of torque or force exerted by the actuator, diagnostic information (e.g., results of diagnostic tests performed by actuators 324-328), status information, commissioning information, configuration settings, calibration data, and/or other types of information or data that can be collected, stored, or used by actuators 324-328. AHU controller 330 can be an economizer controller configured to use one or more control algorithms (e.g., state-based algorithms, extremum seeking control (ESC) algorithms, proportional-integral (PI) control algorithms, proportional-integral-derivative (PID) control algorithms, model predictive control (MPC) algorithms, feedback control algorithms, etc.) to control actuators 324-328.

Still referring to FIG. 3, AHU 302 is shown to include a cooling coil 334, a heating coil 336, and a fan 338 positioned within supply air duct 312. Fan 338 can be configured to force supply air 310 through cooling coil 334 and/or heating coil 336 and provide supply air 310 to building zone 306. AHU controller 330 can communicate with fan 338 via communications link 340 to control a flow rate of supply air 310. In some embodiments, AHU controller 330 controls an amount of heating or cooling applied to supply air 310 by modulating a speed of fan 338.

Cooling coil 334 can receive a chilled fluid from waterside system 200 (e.g., from cold water loop 216) via piping 342 and can return the chilled fluid to waterside system 200 via piping 344. Valve 346 can be positioned along piping 342 or piping 344 to control a flow rate of the chilled fluid through cooling coil 334. In some embodiments, cooling coil 334 includes multiple stages of cooling coils that can be independently activated and deactivated (e.g., by AHU controller 330, by BMS controller 366, etc.) to modulate an amount of cooling applied to supply air 310.

Heating coil 336 can receive a heated fluid from waterside system 200 (e.g., from hot water loop 214) via piping 348 and can return the heated fluid to waterside system 200 via piping 350. Valve 352 can be positioned along piping 348 or piping 350 to control a flow rate of the heated fluid through heating coil 336. In some embodiments, heating coil 336 includes multiple stages of heating coils that can be independently activated and deactivated (e.g., by AHU controller 330, by BMS controller 366, etc.) to modulate an amount of heating applied to supply air 310.

Each of valves 346 and 352 can be controlled by an actuator. For example, valve 346 can be controlled by actuator 354 and valve 352 can be controlled by actuator 356. Actuators 354-356 can communicate with AHU controller 330 via communications links 358-360. Actuators 354-356 can receive control signals from AHU controller 330 and can provide feedback signals to controller 330. In some embodiments, AHU controller 330 receives a measurement of the supply air temperature from a temperature sensor 362 positioned in supply air duct 312 (e.g., downstream of cooling coil 334 and/or heating coil 336). AHU controller 330 can also receive a measurement of the temperature of building zone 306 from a temperature sensor 364 located in building zone 306.

In some embodiments, AHU controller 330 operates valves 346 and 352 via actuators 354-356 to modulate an amount of heating or cooling provided to supply air 310 (e.g., to achieve a setpoint temperature for supply air 310 or to maintain the temperature of supply air 310 within a setpoint temperature range). The positions of valves 346 and 352 affect the amount of heating or cooling provided to supply air 310 by cooling coil 334 or heating coil 336 and may correlate with the amount of energy consumed to achieve a desired supply air temperature. AHU controller 330 may control the temperature of supply air 310 and/or building zone 306 by activating or deactivating coils 334-336, adjusting a speed of fan 338, or a combination of both.

Still referring to FIG. 3, airside system 300 is shown to include a building management system (BMS) controller 366 and a client device 368. BMS controller 366 can include one or more computer systems (e.g., servers, supervisory controllers, subsystem controllers, etc.) that serve as system level controllers, application or data servers, head nodes, or master controllers for airside system 300, waterside system 200, HVAC system 100, and/or other controllable systems that serve building 10. BMS controller 366 can communicate with multiple downstream building systems or subsystems (e.g., HVAC system 100, a security system, a lighting system, waterside system 200, etc.) via a communications link 370 according to like or disparate protocols (e.g., LON, BACnet, etc.). In various embodiments, AHU controller 330 and BMS controller 366 can be separate (as shown in FIG. 3) or integrated. In an integrated implementation, AHU controller 330 can be a software module configured for execution by a processor of BMS controller 366.

In some embodiments, AHU controller 330 receives information from BMS controller 366 (e.g., commands, setpoints, operating boundaries, etc.) and provides information to BMS controller 366 (e.g., temperature measurements, valve or actuator positions, operating statuses, diagnostics, etc.). For example, AHU controller 330 can provide BMS controller 366 with temperature measurements from temperature sensors 362-364, equipment on/off states, equipment operating capacities, and/or any other information that can be used by BMS controller 366 to monitor or control a variable state or condition within building zone 306.

Client device 368 can include one or more human-machine interfaces or client interfaces (e.g., graphical user interfaces, reporting interfaces, text-based computer interfaces, client-facing web services, web servers that provide pages to web clients, etc.) for controlling, viewing, or otherwise interacting with HVAC system 100, its subsystems, and/or devices. Client device 368 can be a computer workstation, a client terminal, a remote or local interface, or any other type of user interface device. Client device 368 can be a stationary terminal or a mobile device. For example, client device 368 can be a desktop computer, a computer server with a user interface, a laptop computer, a tablet, a smartphone, a PDA, or any other type of mobile or non-mobile device. Client device 368 can communicate with BMS controller 366 and/or AHU controller 330 via communications link 372.

Figure 4:
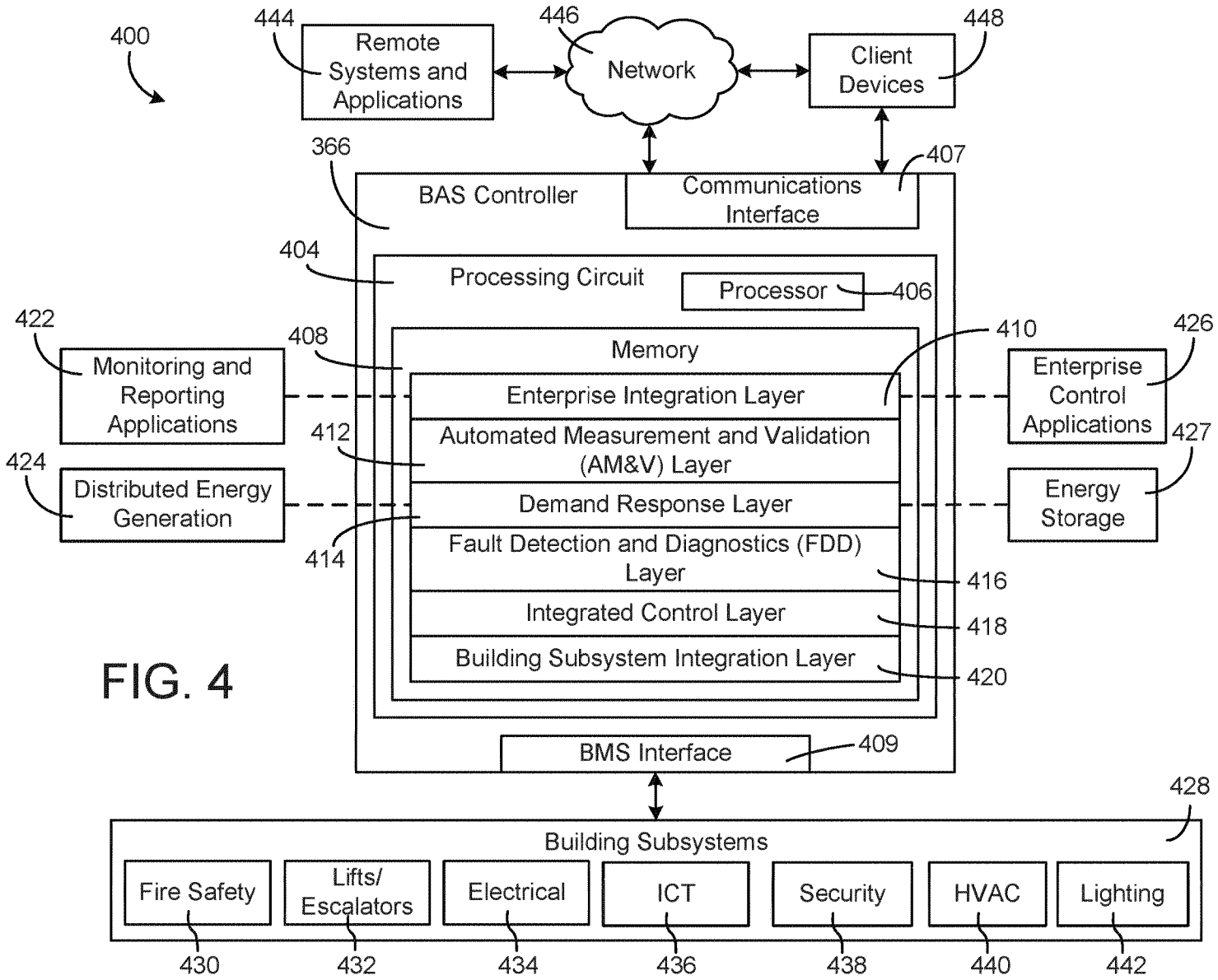
FIG. 4 is a block diagram of a BMS which can be implemented in the building of FIG. 1, according to some embodiments.

Referring now to FIG. 4, a block diagram of a building management system (BMS) 400 is shown, according to some embodiments. BMS 400 can be implemented in building 10 to automatically monitor and control various building functions. BMS 400 is shown to include BMS controller 366 and multiple building subsystems 428. Building subsystems 428 are shown to include a building electrical subsystem 434, an information communication technology (ICT) subsystem 436, a security subsystem 438, a HVAC subsystem 440, a lighting subsystem 442, a lift/escalators subsystem 432, and a fire safety subsystem 430. In various embodiments, building subsystems 428 can include fewer, additional, or alternative subsystems. For example, building subsystems 428 may also or alternatively include a refrigeration subsystem, an advertising or signage subsystem, a cooking subsystem, a vending subsystem, a printer or copy service subsystem, or any other type of building subsystem that uses controllable equipment and/or sensors to monitor or control building 10. In some embodiments, building subsystems 428 include waterside system 200 and/or airside system 300, as described with reference to FIGS. 2-3.

Each of building subsystems 428 can include any number of devices, controllers, and connections for completing its individual functions and control activities. HVAC subsystem 440 can include many of the same components as HVAC system 100, as described with reference to FIGS. 1-3. For example, HVAC subsystem 440 can include and number of chillers, heaters, handling units, economizers, field controllers, supervisory controllers, actuators, temperature sensors, and/or other devices for controlling the temperature, humidity, airflow, or other variable conditions within building 10. Lighting subsystem 442 can include any number of light fixtures, ballasts, lighting sensors, dimmers, or other devices configured to controllably adjust the amount of light provided to a building space. Security subsystem 438 can include occupancy sensors, video surveillance cameras, digital video recorders, video processing servers, intrusion detection devices, access control devices and servers, or other security-related devices.

Still referring to FIG. 4, BMS controller 366 is shown to include a communications interface 407 and a BMS interface 409. Interface 407 can facilitate communications between BMS controller 366 and external applications (e.g., monitoring and reporting applications 422, enterprise control applications 426, remote systems and applications 444, applications residing on client devices 448, etc.) for allowing user control, monitoring, and adjustment to BMS controller 366 and/or subsystems 428. Interface 407 can also facilitate communications between BMS controller 366 and client devices 448. BMS interface 409 can facilitate communications between BMS controller 366 and building subsystems 428 (e.g., HVAC, lighting security, lifts, power distribution, business, etc.).

Interfaces 407, 409 can be or include wired or wireless communications interfaces (e.g., jacks, antennas, transmitters, receivers, transceivers, wire terminals, etc.) for conducting data communications with building subsystems 428 or other external systems or devices. In various embodiments, communications via interfaces 407, 409 can be direct (e.g., local wired or wireless communications) or via a communications network 446 (e.g., a WAN, the Internet, a cellular network, etc.). For example, interfaces 407, 409 can include an Ethernet card and port for sending and receiving data via an Ethernet-based communications link or network. In another example, interfaces 407, 409 can include a WiFi transceiver for communicating via a wireless communications network. In another example, one or both of interfaces 407, 409 can include cellular or mobile phone communications transceivers. In one embodiment, communications interface 407 is a power line communications interface and BMS interface 409 is an Ethernet interface. In other embodiments, both communications interface 407 and BMS interface 409 are Ethernet interfaces or are the same Ethernet interface.

Still referring to FIG. 4, BMS controller 366 is shown to include a processing circuit 404 including a processor 406 and memory 408. Processing circuit 404 can be communicably connected to BMS interface 409 and/or communications interface 407 such that processing circuit 404 and the various components thereof can send and receive data via interfaces 407, 409. Processor 406 can be implemented as a general purpose processor, an application specific integrated circuit (ASIC), one or more field programmable gate arrays (FPGAs), a group of processing components, or other suitable electronic processing components.

Memory 408 (e.g., memory, memory unit, storage device, etc.) can include one or more devices (e.g., RAM, ROM, Flash memory, hard disk storage, etc.) for storing data and/or computer code for completing or facilitating the various processes, layers and modules described in the present application. Memory 408 can be or include volatile memory or non-volatile memory. Memory 408 can include database components, object code components, script components, or any other type of information structure for supporting the various activities and information structures described in the present application. According to some embodiments, memory 408 is communicably connected to processor 406 via processing circuit 404 and includes computer code for executing (e.g., by processing circuit 404 and/or processor 406) one or more processes described herein.

In some embodiments, BMS controller 366 is implemented within a single computer (e.g., one server, one housing, etc.). In various other embodiments BMS controller 366 can be distributed across multiple servers or computers (e.g., that can exist in distributed locations). Further, while FIG. 4 shows applications 422 and 426 as existing outside of BMS controller 366, in some embodiments, applications 422 and 426 can be hosted within BMS controller 366 (e.g., within memory 408).

Still referring to FIG. 4, memory 408 is shown to include an enterprise integration layer 410, an automated measurement and validation (AM&V) layer 412, a demand response (DR) layer 414, a fault detection and diagnostics (FDD) layer 416, an integrated control layer 418, and a building subsystem integration later 420. Layers 410-420 can be configured to receive inputs from building subsystems 428 and other data sources, determine optimal control actions for building subsystems 428 based on the inputs, generate control signals based on the optimal control actions, and provide the generated control signals to building subsystems 428. The following paragraphs describe some of the general functions performed by each of layers 410-420 in BMS 400.

Enterprise integration layer 410 can be configured to serve clients or local applications with information and services to support a variety of enterprise-level applications. For example, enterprise control applications 426 can be configured to provide subsystem-spanning control to a graphical user interface (GUI) or to any number of enterprise-level business applications (e.g., accounting systems, user identification systems, etc.). Enterprise control applications 426 can also or alternatively be configured to provide configuration GUIs for configuring BMS controller 366. In yet other embodiments, enterprise control applications 426 can work with layers 410-420 to optimize building performance (e.g., efficiency, energy use, comfort, or safety) based on inputs received at interface 407 and/or BMS interface 409.

Building subsystem integration layer 420 can be configured to manage communications between BMS controller 366 and building subsystems 428. For example, building subsystem integration layer 420 can receive sensor data and input signals from building subsystems 428 and provide output data and control signals to building subsystems 428. Building subsystem integration layer 420 can also be configured to manage communications between building subsystems 428. Building subsystem integration layer 420 translate communications (e.g., sensor data, input signals, output signals, etc.) across multiple multi-vendor/multi-protocol systems.

Demand response layer 414 can be configured to optimize resource usage (e.g., electricity use, natural gas use, water use, etc.) and/or the monetary cost of such resource usage in response to satisfy the demand of building 10. The optimization can be based on time-of-use prices, curtailment signals, energy availability, or other data received from utility providers, distributed energy generation systems 424, from energy storage 427 (e.g., hot TES 242, cold TES 244, etc.), or from other sources. Demand response layer 414 can receive inputs from other layers of BMS controller 366 (e.g., building subsystem integration layer 420, integrated control layer 418, etc.). The inputs received from other layers can include environmental or sensor inputs such as temperature, carbon dioxide levels, relative humidity levels, air quality sensor outputs, occupancy sensor outputs, room schedules, and the like. The inputs can also include inputs such as electrical use (e.g., expressed in kWh), thermal load measurements, pricing information, projected pricing, smoothed pricing, curtailment signals from utilities, and the like.

According to some embodiments, demand response layer 414 includes control logic for responding to the data and signals it receives. These responses can include communicating with the control algorithms in integrated control layer 418, changing control strategies, changing setpoints, or activating/deactivating building equipment or subsystems in a controlled manner. Demand response layer 414 can also include control logic configured to determine when to utilize stored energy. For example, demand response layer 414 can determine to begin using energy from energy storage 427 just prior to the beginning of a peak use hour.

In some embodiments, demand response layer 414 includes a control module configured to actively initiate control actions (e.g., automatically changing setpoints) which minimize energy costs based on one or more inputs representative of or based on demand (e.g., price, a curtailment signal, a demand level, etc.). In some embodiments, demand response layer 414 uses equipment models to determine an optimal set of control actions. The equipment models can include, for example, thermodynamic models describing the inputs, outputs, and/or functions performed by various sets of building equipment. Equipment models may represent collections of building equipment (e.g., subplants, chiller arrays, etc.) or individual devices (e.g., individual chillers, heaters, pumps, etc.).

Demand response layer 414 can further include or draw upon one or more demand response policy definitions (e.g., databases, XML files, etc.). The policy definitions can be edited or adjusted by a user (e.g., via a graphical user interface) so that the control actions initiated in response to demand inputs can be tailored for the user's application, desired comfort level, particular building equipment, or based on other concerns. For example, the demand response policy definitions can specify which equipment can be turned on or off in response to particular demand inputs, how long a system or piece of equipment should be turned off, what setpoints can be changed, what the allowable set point adjustment range is, how long to hold a high demand setpoint before returning to a normally scheduled setpoint, how close to approach capacity limits, which equipment modes to utilize, the energy transfer rates (e.g., the maximum rate, an alarm rate, other rate boundary information, etc.) into and out of energy storage devices (e.g., thermal storage tanks, battery banks, etc.), and when to dispatch on-site generation of energy (e.g., via fuel cells, a motor generator set, etc.).

Integrated control layer 418 can be configured to use the data input or output of building subsystem integration layer 420 and/or demand response later 414 to make control decisions. Due to the subsystem integration provided by building subsystem integration layer 420, integrated control layer 418 can integrate control activities of the subsystems 428 such that the subsystems 428 behave as a single integrated supersystem. In some embodiments, integrated control layer 418 includes control logic that uses inputs and outputs from multiple building subsystems to provide greater comfort and energy savings relative to the comfort and energy savings that separate subsystems could provide alone. For example, integrated control layer 418 can be configured to use an input from a first subsystem to make an energy-saving control decision for a second subsystem. Results of these decisions can be communicated back to building subsystem integration layer 420.

Integrated control layer 418 is shown to be logically below demand response layer 414. Integrated control layer 418 can be configured to enhance the effectiveness of demand response layer 414 by enabling building subsystems 428 and their respective control loops to be controlled in coordination with demand response layer 414. This configuration can advantageously reduce disruptive demand response behavior relative to conventional systems. For example, integrated control layer 418 can be configured to assure that a demand response-driven upward adjustment to the setpoint for chilled water temperature (or another component that directly or indirectly affects temperature) does not result in an increase in fan energy (or other energy used to cool a space) that would result in greater total building energy use than was saved at the chiller.

Integrated control layer 418 can be configured to provide feedback to demand response layer 414 so that demand response layer 414 checks that constraints (e.g., temperature, lighting levels, etc.) are properly maintained even while demanded load shedding is in progress. The constraints can also include setpoint or sensed boundaries relating to safety, equipment operating limits and performance, comfort, fire codes, electrical codes, energy codes, and the like. Integrated control layer 418 is also logically below fault detection and diagnostics layer 416 and automated measurement and validation layer 412. Integrated control layer 418 can be configured to provide calculated inputs (e.g., aggregations) to these higher levels based on outputs from more than one building subsystem.

Automated measurement and validation (AM&V) layer 412 can be configured to verify that control strategies commanded by integrated control layer 418 or demand response layer 414 are working properly (e.g., using data aggregated by AM&V layer 412, integrated control layer 418, building subsystem integration layer 420, FDD layer 416, or otherwise). The calculations made by AM&V layer 412 can be based on building system energy models and/or equipment models for individual BMS devices or subsystems. For example, AM&V layer 412 can compare a model-predicted output with an actual output from building subsystems 428 to determine an accuracy of the model.

Fault detection and diagnostics (FDD) layer 416 can be configured to provide on-going fault detection for building subsystems 428, building subsystem devices (i.e., building equipment), and control algorithms used by demand response layer 414 and integrated control layer 418. FDD layer 416 can receive data inputs from integrated control layer 418, directly from one or more building subsystems or devices, or from another data source. FDD layer 416 can automatically diagnose and respond to detected faults. The responses to detected or diagnosed faults can include providing an alert message to a user, a maintenance scheduling system, or a control algorithm configured to attempt to repair the fault or to work-around the fault.

FDD layer 416 can be configured to output a specific identification of the faulty component or cause of the fault (e.g., loose damper linkage) using detailed subsystem inputs available at building subsystem integration layer 420. In other embodiments, FDD layer 416 is configured to provide "fault" events to integrated control layer 418 which executes control strategies and policies in response to the received fault events. According to some embodiments, FDD layer 416 (or a policy executed by an integrated control engine or business rules engine) can shut-down systems or direct control activities around faulty devices or systems to reduce energy waste, extend equipment life, or assure proper control response.

FDD layer 416 can be configured to store or access a variety of different system data stores (or data points for live data). FDD layer 416 can use some content of the data stores to identify faults at the equipment level (e.g., specific chiller, specific AHU, specific terminal unit, etc.) and other content to identify faults at component or subsystem levels. For example, building subsystems 428 can generate temporal (i.e., time-series) data indicating the performance of BMS 400 and the various components thereof. The data generated by building subsystems 428 can include measured or calculated values that exhibit statistical characteristics and provide information about how the corresponding system or process (e.g., a temperature control process, a flow control process, etc.) is performing in terms of error from its setpoint. These processes can be examined by FDD layer 416 to expose when the system begins to degrade in performance and alert a user to repair the fault before it becomes more severe.

Actuator with Removable DIP Switch Circuit Card Assembly

Figure 5:
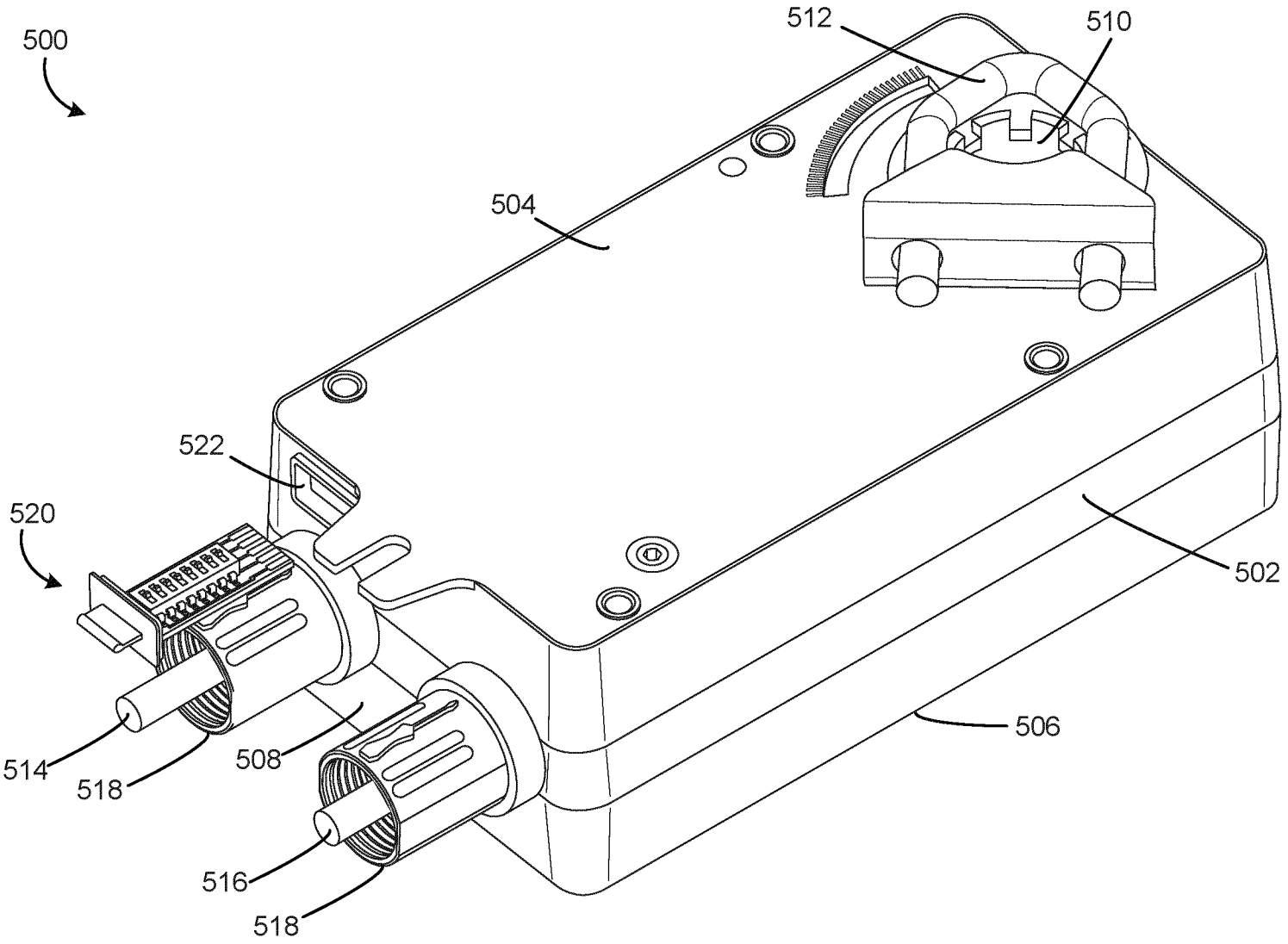
FIG. 5 is a exploded perspective view of an actuator with a removable DIP switch CCA that can be implemented in the BMS of FIG. 1, according to some embodiments.

Referring now to FIG. 5, an exploded view of an actuator 500 for use in a HVAC system is shown, according to some embodiments. In some implementations, actuator 500 can be used in HVAC system 100, waterside system 200, airside system 300, or BMS 400, as described with reference to FIGS. 1-4. For example, actuator 500 can be a damper actuator, a valve actuator, a fan actuator, a pump actuator, or any other type of actuator that can be used in a HVAC system or BMS. In various embodiments, actuator 500 can be a linear actuator (e.g., a linear proportional actuator), a non-linear actuator, a spring return actuator, or a non-spring return actuator.

Actuator 500 is shown to include a housing 502 having multiple exterior surfaces, including a front side 504, a rear side 506 opposite front side 504, and a bottom side 508. Housing 502 can contain the mechanical and processing components of the actuator 500. The internal components of the actuator 500 are described in greater detail with reference to FIG. 8 below. Actuator 500 is further shown to include a drive device 510. Drive device 510 can be a drive mechanism, a hub, or other device configured to drive or effectuate movement of an HVAC system component. For example, drive device 510 can be configured to receive a shaft of a damper, a valve, or any other movable HVAC system component in order to drive (e.g., rotate) a shaft. In some embodiments, actuator 500 includes a coupling device 512 configured to aid in coupling drive device 510 to the movable HVAC system component. For example, coupling device 512 can facilitate attaching drive device 510 to a valve or damper shaft.

Actuator 500 is also shown to include a communication cable connection 514 and an input/output cable connection 516. In some embodiments, communication cable connection 514 and input/output cable connection 516 are located along the bottom 508 of the housing 502. In other embodiments, communication cable connection 514 and input/output cable connection 516 may be located along another surface of the housing 502. Input/output cable connection 516 may be configured to receive a control signal (e.g., a voltage input signal) from an external system or device. Actuator 500 may use the control signal to determine an appropriate output for the motor. In various embodiments, the control signal is received from a controller such as an AHU controller (e.g., AHU controller 330), an economizer controller, a supervisory controller (e.g., BMS controller 366), a zone controller, a field controller, an enterprise level controller, a motor controller, an equipment-level controller (e.g., an actuator controller) or any other type of controller that can be used in a HVAC system or BMS. In some embodiments, the control signal is a DC voltage signal (e.g., 0.0 VDC-10.0 VDC). In other embodiments, the control signal is an AC voltage signal having a voltage of 24 VAC or a standard power line voltage (e.g., 120 VAC or 230 VAC at 50/60 Hz).

In some embodiments, input/output cable connection 516 may be further configured to provide a feedback signal to a controller of the HVAC system or BMS in which actuator 500 in implemented (e.g., an AHU controller, an economizer controller, a supervisory controller, a zone controller, a field controller, an enterprise level controller). The feedback signal may indicate the rotational position of actuator 500. Communication cable connection 514 and input/output cable connection 516 may be connected to the controller via a communications bus. The communication bus may be a wired or wireless communications link and may use any of a variety of disparate communications protocols (e.g., BACnet, LON, WiFi, Bluetooth, NFC, TCP/IP). In some embodiments, one or both of the communication cable connection 514 and the input/output cable connection 516 may be shielded by conduits (not shown) and conduit adaptors 518 which couple to the bottom side 508 of the actuator housing 502. In some embodiments, the actuator conduit adaptors 518 are the adaptors described in U.S. patent application Ser. No. 15/166,190, filed May 26, 2016. The application is incorporated herein by reference in its entirety.

Still referring to FIG. 5, actuator 500 is also shown to include a removable dual in-line package (DIP) switch circuit card assembly (CCA) 520. The DIP switch CCA 520 is a daughter card configured to be fully separable from a main processing card located within the actuator 500. Further details of the removable DIP switch CCA 520 are included below with reference to FIGS. 6-7. The DIP switch CCA 520 can be coupled and decoupled from the actuator enclosure 502 through an aperture 522. For example, the DIP switch CCA 520 can be inserted into aperture 522 and removed from aperture 522. The size of aperture 522 may be sufficiently large to permit easy passage of the DIP switch CCA 520 through the aperture 522 without creating an undue risk of fluid and/or debris ingress into the actuator enclosure 502 through the aperture 522. In some embodiments, the aperture 522 may also include features (e.g., asymmetrical keyhole shape, snap fit components) that prevent installation of the DIP switch CCA 520 into the actuator enclosure 502 in an incorrect orientation.

Figure 6:
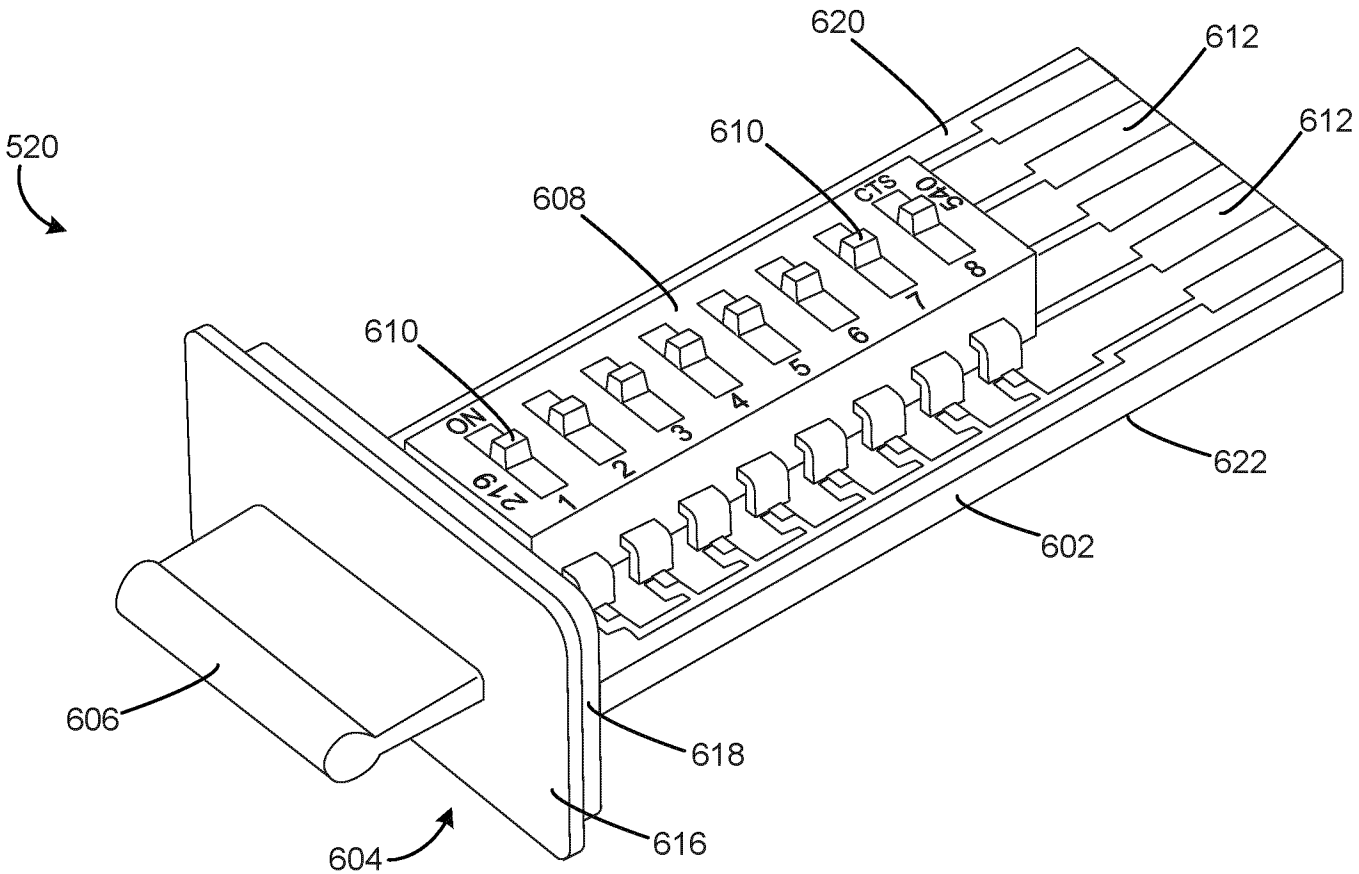
FIG. 6 is a perspective view of the removable DIP switch CCA of FIG. 5, according to some embodiments.
Figure 7:
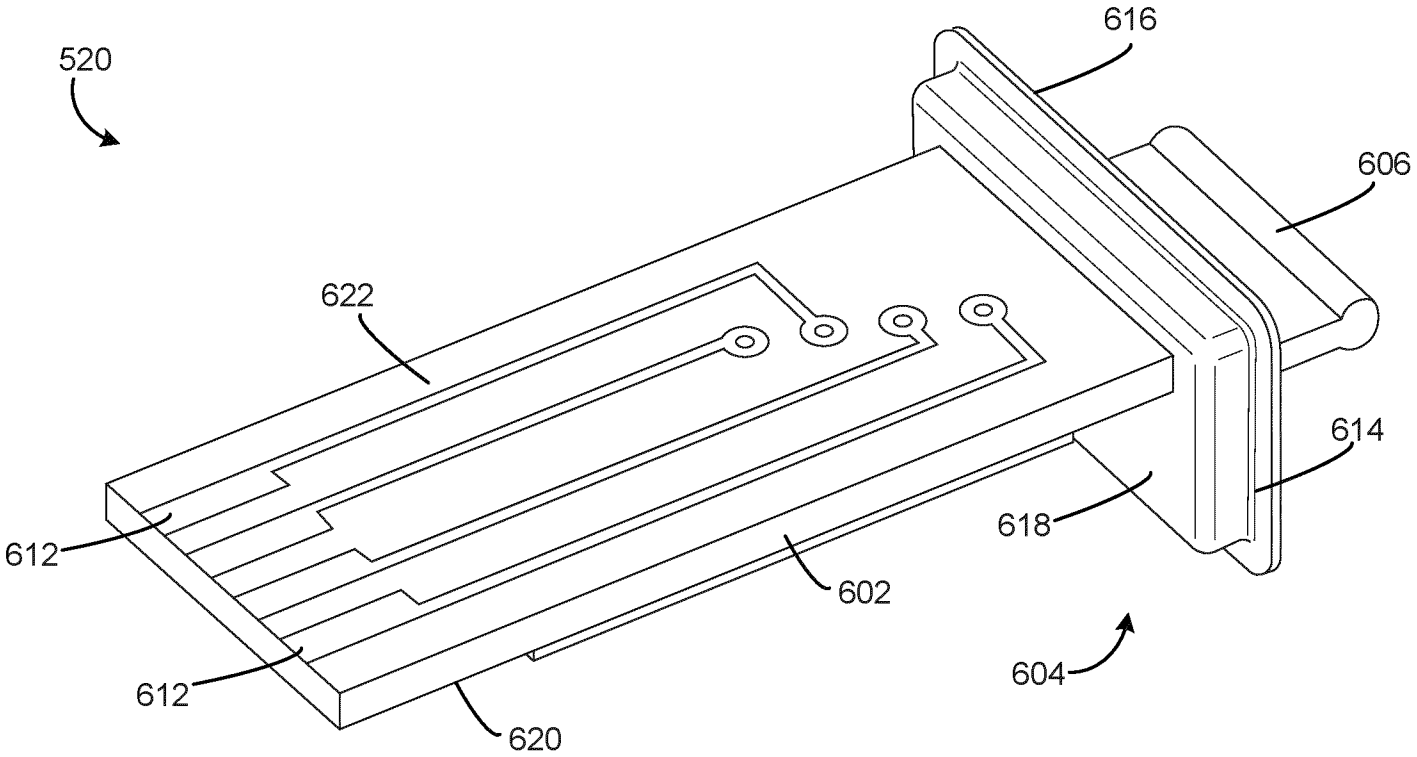
FIG. 7 is another perspective view of the removable DIP switch CCA of FIG. 5, according to some embodiments.
Figure 9:
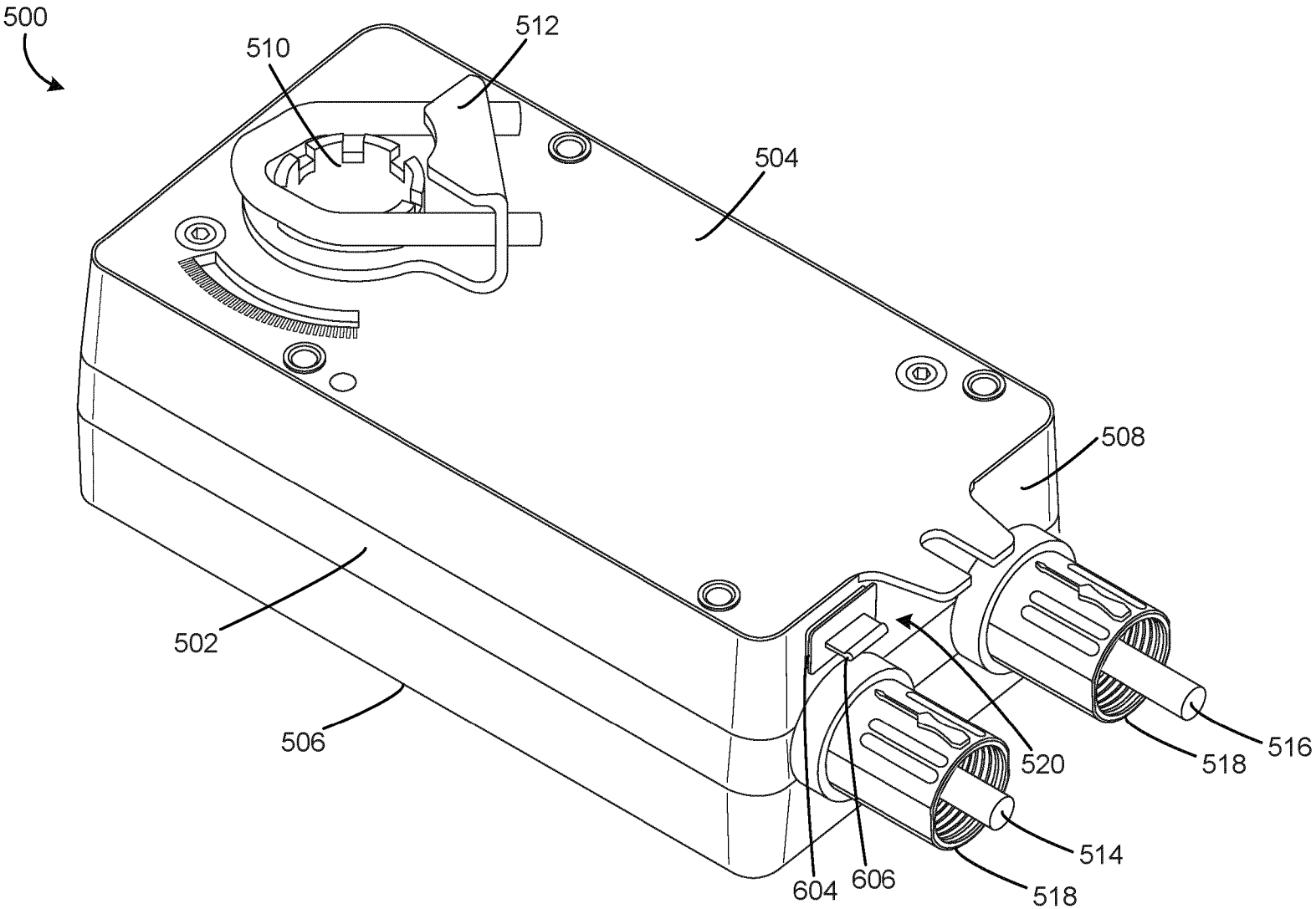
FIG. 9 is a perspective view of the actuator illustrated in FIG. 5 with the removable DIP switch CCA in a fully installed configuration, according to some embodiments.

Turning now to FIGS. 6-7, perspective views of the removable DIP switch CCA 520 are shown, according to some embodiments. The DIP switch CCA 520 is shown to include a printed wiring board (PWB) 602 coupled to an enclosure cap 604. The PWB 602 may be coupled to the enclosure cap 604 using any suitable fastening method (e.g., mechanical fasteners, adhesives). The enclosure cap 604 is shown to include an exterior flange portion 616 and an interior flange portion 618. In some embodiments, the exterior flange portion 616 may be configured to sit flush or nearly flush with the bottom side 508 of the actuator housing 502 and the interior flange portion 618 may be configured to fit within the actuator housing 502 when the DIP switch CCA 520 is in a fully installed configuration, as depicted in FIG. 9 and described in further detail below. The enclosure cap 604 is further shown to include a handle 606 that permits a user to grip the enclosure cap 604 to decouple the DIP switch CCA 520 from the actuator housing 502. In some embodiments, as depicted in FIGS. 6-7, the handle 606 is a stationary protrusion that extends from the exterior flange portion 616. In other embodiments, the handle 606 may be pivotally coupled to the exterior flange portion 616, and may fit within a recess in the exterior flange portion 616 when not in use.

Referring specifically in FIG. 7, the enclosure cap 604 may further include an integral seal component 614. In some embodiments, the seal component 614 is positioned at the joint coupling the exterior flange portion 616 to the interior flange portion 618. The seal component 614 may be configured to prevent the ingress of fluid and/or debris into the actuator enclosure 502 when the DIP switch CCA 520 is in the fully installed configuration. Seal component 614 may be fabricated from any suitable material, using any suitable method. For example, in some embodiments, the seal component 614 is an O-ring fabricated from an elastomeric material.

Turning back to FIG. 6, a DIP switch component 608 with multiple DIP switches 610 is shown to be mounted on the PWB 602. PWB 602 is shown to include a component side 620 and a bottom side 622. In various embodiments, the DIP switch component 608 may be coupled to the component side 620 of the PWB 602 via any suitable method, including surface-mount technology (SMT) and through-hole technology (THT) methods. The PWB 602 may be any size (i.e., length, width, number of layers) required to mount the DIP switch component 608. The DIP switch component 608 is shown to include eight discrete DIP switches 610. In various embodiments, DIP switch component 608 includes any required number of switches (e.g., ten DIP switches 610, sixteen DIP switches 610). The DIP switches 610 depicted in FIG. 6 are single pole, single throw (SPST) slide switches that may be actuated between an ON position and an OFF position. In other embodiments, the DIP switches are rocker or piano-style switches that each may be similarly actuated between an ON position and an OFF position. The slide, rocker, and piano-style switches permit each DIP switch 610 to select a one-bit binary value. In other words, a DIP switch 610 actuated to an ON position may output a nonzero voltage value (e.g., 5 V) to represent selection of a binary digit with a value of 1, while a DIP switch 610 actuated to an OFF position may output a zero voltage value to represent selection of a binary digit with a value of 0.

In some embodiments, the DIP switch component 608 may generate an output signal as a single number. For example, a package containing seven DIP switches 610 offers 128 possible switch combinations, permitting the selection of a standard ASCII character. A package containing eight DIP switches 610 offers 256 possible switch combinations, equivalent to one byte. In still further embodiments, the DIP switch component 608 is a rotary DIP switch configured to provide binary coded decimal, hexadecimal code, or single pole output.

The removable DIP switch CCA 520 is further shown to include multiple connector pins 612 on the end of the PWB 602 opposite the enclosure cap 604. The number of connector pins 612 may be related to the number of DIP switches 610 included on the DIP switch component 608. For example, as depicted in FIGS. 6-7, the DIP switch component 608 contains eight DIP switches 610 and nine connector pins 612 (e.g., five connector pins 612 located on the component side 620 of the PWB 602 and four connector pins 612 located on the bottom side 622 of the PWB 602). The connector pins 612 may be configured to electrically couple with a connector mounted within the actuator housing 502. For example, in some embodiments, the connector pins 612 may mate with a commercial off the shelf (COTS) connector mounted on the main actuator circuit card assembly.

Figure 8:
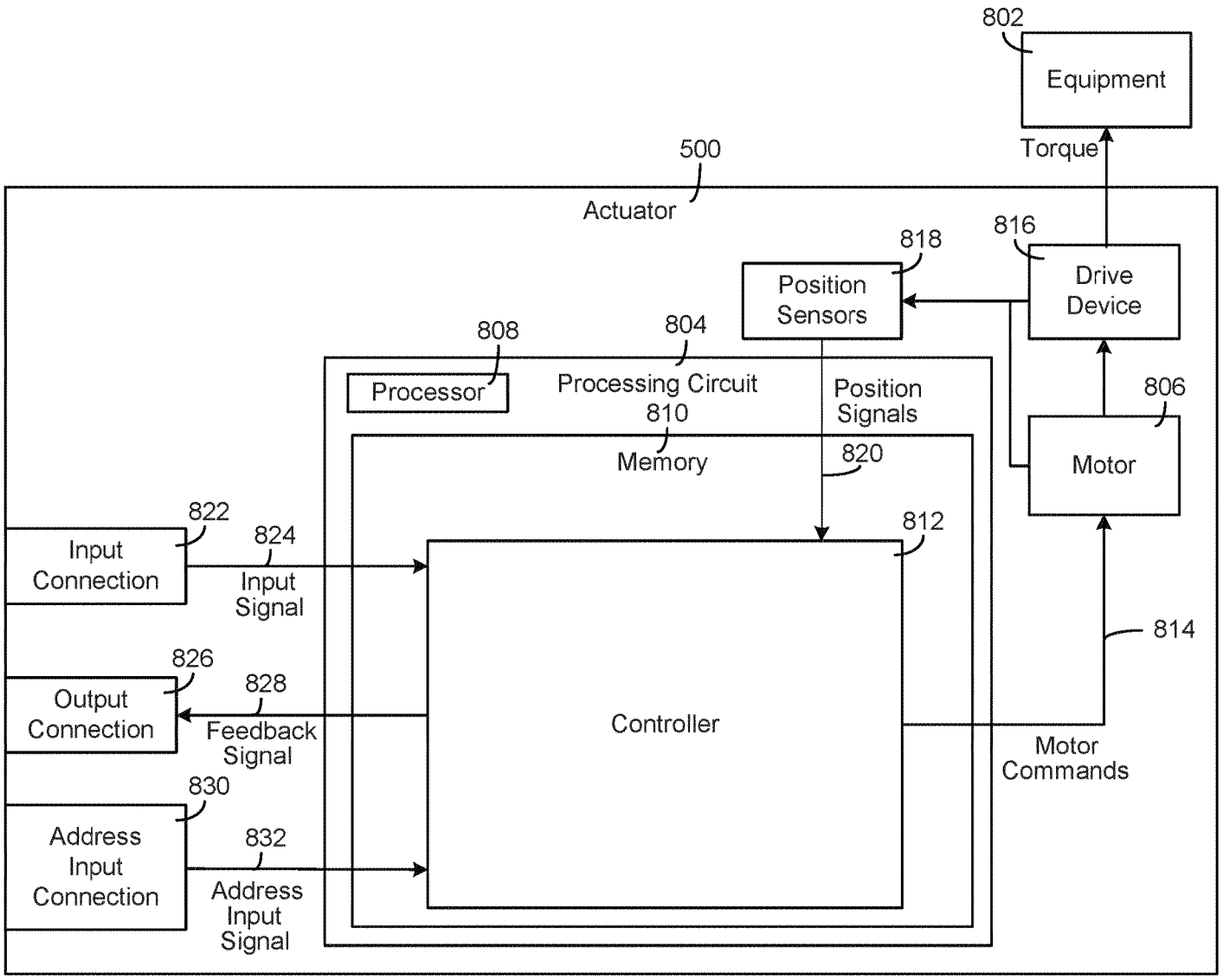
FIG. 8 is a block diagram of the actuator illustrated in FIG. 5, according to some embodiments.

Referring now to FIG. 8, a block diagram of the actuator 500 is shown, according to some embodiments. Actuator 500 may be configured to operate equipment 802. Equipment 802 may be any type of system or device than can be operated by an actuator (e.g., a damper, a valve). Actuator 500 is shown to include a processing circuit 804 coupled to a motor 806. In some embodiments, motor 806 is a brushless DC (BLDC) motor. The motor 806 is connected to a drive device 816 that operates the equipment 802. Position sensors 818 are configured to measure the position of the motor 806 and/or the drive device 816. Position sensors may include Hall effect sensors, potentiometers, optical sensors, or other types of sensors configured to measure the rotational position of the motor 806 and/or the drive device 816. The processing circuit 804 uses position signals 820 from the position sensors 818 to determine whether to operate the motor 806. For example, the processing circuit 804 may compare the current position of the drive device 816 with a position setpoint and may operate the motor 806 to achieve the position setpoint.

The processing circuit 804 is also shown to include a processor 808, memory 810, and a main actuator controller 812. In various embodiments, the processing circuit 804 is packaged as a single CCA. Processor 808 can be a general purpose or specific purpose processor, an application specific integrated circuit (ASIC), one or more field programmable gate arrays (FPGAs), a group of processing components, or other suitable processing components. Processor 808 can be configured to execute computer code or instruction stored in memory 810 or received from other computer readable media (e.g., CDROM, network storage, a remote server).

Memory 810 may include one or more devices (e.g., memory units, memory devices, storage devices) for storing data and/or computer code for completing and/or facilitating the various processes described in the present disclosure. Memory 810 may include random access memory (RAM), read-only memory (ROM), hard drive storage, temporary storage, non-volatile memory, flash memory, optical memory, or any other suitable memory for storing software objects and/or computer instructions. Memory 810 may include database components, object code components, script components, or any other type of information structure for supporting the various activities and information structures described in the present disclosure. Memory 810 can be communicably coupled to processor 808 via processing circuit 804 and may include computer code for executing (e.g., by processor 808) one or more processes described herein. When processor 808 executes instructions stored in memory 810, processor 808 generally configures actuator 500 (and more particularly processing circuit 804) to complete such activities.

The controller 812 of the main processing circuit 804 is shown to be coupled to an input connection 822, an output connection 826, and an address input connection 830. The input connection 822 is configured to couple to the input/output cable connection 516 (described above with reference to FIG. 5) to enable transmission of an input signal 824 from an external controller (e.g., an AHU controller, a supervisory controller, a zone controller, a field controller) to the controller 812. Similarly, the output connection 826 is configured to couple to the input/output cable connection 516 to enable transmission of a feedback signal 828 from the controller 812 to the external controller. The address input connection 830 is configured to couple to the removable DIP switch CCA 520 to enable transmission of an address input signal 832 to the controller 812. The address input signal 832 may be a set of voltage signals, where each of the set of voltage signals is based on the position of a corresponding DIP switch 610 on the DIP switch component 608. Thus, data transmitted via the address input signal 832 may vary based on the configuration of the DIP switches 610. For example, in some embodiments, the data transmitted to the controller 812 using the address input signal 832 may be the device address that is used to uniquely identify the actuator 500 to other devices in the HVAC system or BMS (e.g., HVAC system 100, BMS 400). In other embodiments, the data transmitted to the controller 812 using the address input signal 832 may include operational settings for the actuator 500 (e.g., selection of a spring return direction).

Turning now to FIG. 9, a perspective view of the actuator 500 with the removable DIP switch CCA 520 in the fully installed configuration is shown. As described above, the actuator 500 includes a housing 502 having a front side 504, a rear side 506, and a bottom side 508, with the communication cable connection 514 and the input/output cable connection 516 located on the bottom side 508. In the fully installed configuration, DIP switch CCA 520 is shown to be oriented parallel to the communication cable connection 514 and the input/output cable connection 516, with the handle 606 of the enclosure cap 604 protruding from the bottom side 508 of the housing 502. By locating the DIP switch CCA 520 in this way, the space allotted for the communication cable connection 514, the input/output cable connection 516, and the actuator conduit adaptors 518 ensures that the actuator 500 will always be installed in an orientation that permits a user to grasp the handle 606 and remove the DIP switch CCA 520 from the housing 502. In other words, the presence of the communication cable connection 514 and the input/output cable connection 516 means that the actuator 500 will never be installed with the bottom side 508 facing ductwork or other structural building components that would inhibit removal of the DIP switch CCA 520 from the housing 502.

Figure 10:
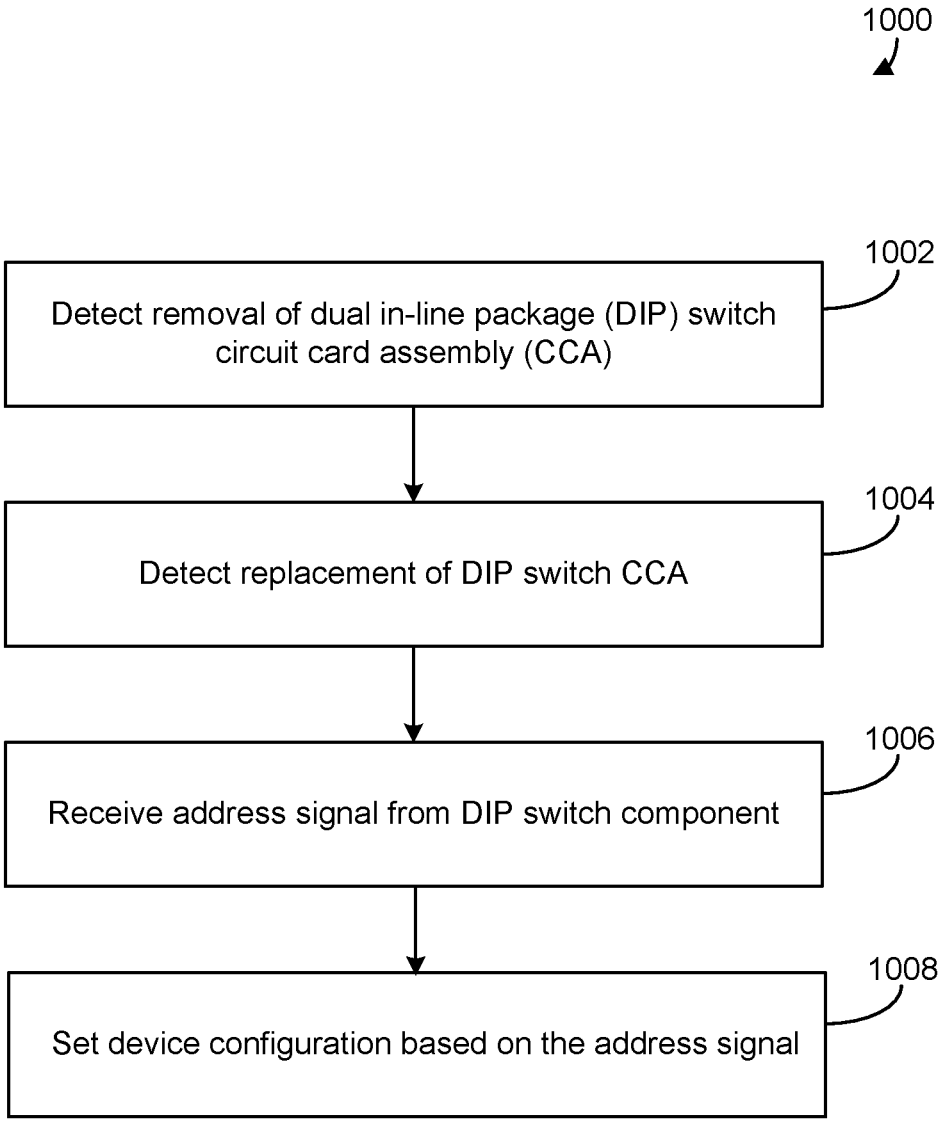
FIG. 10 is a flow chart of process for assigning a device address using the removable DIP switch CCA, according to some embodiments.

Referring now to FIG. 10, a flow chart of a process 1000 for changing a device configuration using a removable DIP switch CCA is shown, according to an exemplary embodiment. Process 1000 may be performed by the processing circuit 804 of the actuator 500, as described above with reference to FIGS. 5-9. Process 1000 is shown to commence with step 1002, in which the processing circuit 804 detects the removal of the DIP switch CCA 520 from the actuator enclosure 502. For example, the controller 812 may detect the absence of the address input signal 832 that is normally received from the address input connection 830. In some embodiments, the controller 812 may be configured to continuously monitor for the presence of the address input signal 832 and therefore may detect the absence of the address input signal 832 as soon as the DIP switch CCA 520 is removed from the actuator enclosure 502. In other embodiments, the controller 812 may be configured to monitor the presence of the address input signal 832 only at specified intervals, and thus may detect the absence of the address input signal 832 at the expiration of a scheduled interval. In some embodiments, the processing circuit 804 may perform various actions in response to detection of the absence of address input signal 832. For example, the DIP switch CCA 520 may be removed from the actuator enclosure 502 if the device address is set incorrectly. In this scenario, the memory 810 may delete stored device address data in preparation to receive new device address data.

Process 1000 is also shown to include step 1004, in which the processing circuit 804 detects the replacement of the DIP switch CCA 520. Between steps 1002 and 1004, it is presumed that a user has modified the positions of the DIP switches 610 on the DIP switch component 608. In some embodiments, step 1004 may include the controller 812 detecting the presence of the address input signal 832 from the address input connection 830. In various embodiments, the controller 812 may detect the presence of the address input signal 832 immediately, or at the expiration of a scheduled interval.

Process 1000 is further shown to include step 1006, in which the processing circuit 804 receives the address input signal 832. As described above, the address input signal 832 may be a set of voltage signals generated by the DIP switch component 608 on the DIP switch CCA 520. Each of the set of voltage signals may correspond to the position of a DIP switch 610. The process 1000 may conclude at step 1008, in which the controller 812 sets a device configuration based on the address input signal 832. As described above, in some embodiments, the device configuration may be a device address that uniquely identifies the actuator device to other devices in the HVAC system or BMS. In other embodiments, the device configuration is an operational setting that modifies the actuator device performance. The controller 812 may perform various actions in response to receiving the address input signal 832 and setting the device configuration. For example, in some embodiments, the controller 812 may generate motor commands 814 for the motor 806 based on the operational setting. In other embodiments, the controller 812 may transmit a device address received from the address input signal 832 to an external controller using the output connection 826 and the feedback signal 828.

Although the embodiments of the removable DIP switch CCA described above have been described exclusively with reference to use in an actuator device, nothing in this disclosure should be read as limiting the application of the removable DIP switch CCA to actuator devices. Indeed, the removable DIP switch CCA described in the present disclosure may be implemented in any type of electronic device (e.g., an HVAC device) utilizing a DIP switch component package for device address selection, configuration selection, or any other function.

Configuration of Example Embodiments

The construction and arrangement of the systems and methods as shown in the some embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the embodiments without departing from the scope of the present disclosure.

The present disclosure contemplates methods, systems and program products on any machine-readable media for accomplishing various operations. The embodiments of the present disclosure can be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps can be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. An actuator in an HVAC system, the actuator comprising:

a motor;

a drive device driven by the motor and coupled to a movable HVAC component for driving the movable HVAC component between multiple positions;

a dual in-line package (DIP) switch circuit card assembly configured to be removed from the actuator;

a processing circuit coupled to the motor and the removable DIP switch circuit card assembly and configured to operate the motor to drive the drive device; and an enclosure configured to at least partially encapsulate the motor, the drive device, the removable DIP switch circuit card assembly, and the processing circuit.

2. The actuator of claim 1, further comprising at least one cable connection coupled with an exterior surface of the enclosure.

3. The actuator of claim 2, wherein the exterior surface of the enclosure comprises an aperture configured to permit the DIP switch circuit card assembly to be decoupled from the processing circuit in a direction parallel to the at least one cable connection.

4. The actuator of claim 1, wherein the DIP switch circuit card assembly comprises:

a printed wiring board;

an enclosure cap coupled to the printed wiring board; and a DIP switch component coupled to the printed wiring board and comprising a plurality of DIP switches.

5. The actuator of claim 4, wherein the processing circuit is further configured to set an address for the actuator based on positions of the plurality of DIP switches.

6. The actuator of claim 4, wherein each of the plurality of DIP switches is configured to be actuated between a first position and a second position.

7. The actuator of claim 6, wherein actuating one of the plurality of DIP switches into the first position causes the DIP switch component to transmit a nonzero voltage signal, and actuating the one of the plurality of DIP switches into the second position causes the DIP switch component to transmit a zero voltage signal.

8. The actuator of claim 4, wherein the DIP switch circuit card assembly further comprises a plurality of connector pins configured to electrically couple to a connector coupled to the processing circuit.

9. The actuator of claim 4, wherein the enclosure cap comprises an exterior flange portion and an interior flange portion, the exterior flange portion configured to sit flush with an exterior surface of the enclosure when the DIP switch circuit card assembly is in a fully installed position.

10. The actuator of claim 9, wherein the exterior flange portion comprises a handle protrusion configured to be gripped by a user to decouple the DIP switch circuit card assembly from the processing circuit.

11. The actuator of claim 9, wherein the enclosure cap further comprises a seal component coupled with a joint coupling the exterior flange portion to the interior flange portion, the seal component configured to prevent fluid ingress into the enclosure.

12. The actuator of claim 1, wherein:

the DIP switch circuit card assembly is insertable into the actuator; and the actuator is configured to enclose the DIP switch circuit card assembly in response to the DIP switch circuit card assembly being inserted into the actuator.

13. A heating, ventilation, or air conditioning (HVAC) device in an HVAC system, the HVAC device comprising:

a dual in-line package (DIP) switch circuit card assembly configured to be removed from the HVAC device;

a processing circuit coupled to the DIP switch circuit card assembly; and an enclosure configured to at least partially encapsulate the removable DIP switch circuit card assembly and the processing circuit.

14. The HVAC device of claim 13, wherein the HVAC device is configured to enclose the DIP switch circuit card assembly in response to the DIP switch circuit card assembly being inserted into the HVAC device.

15. The HVAC device of claim 13, wherein the DIP switch circuit card assembly is coupled with a grasping portion and the DIP switch circuit card assembly is removable via translation of the grasping portion.

* * * * *